US005431334A

United States Patent [19]

Mattson

[11] Patent Number: 5,431,334

[45] Date of Patent: Jul. 11, 1995

[54] SLIDE WELD HANDLE

[75] Inventor: Larry J. Mattson, Charlotte, N.C.

[73] Assignee: Roberts Systems, Inc., Charlotte, N.C.

[21] Appl. No.: 251,776

[22] Filed: May 31, 1994

[51] Int. Cl.[6] ..... B65D 5/465

[52] U.S. Cl. ..... 229/117.22; 229/117.25; 229/117.26

[58] Field of Search ..... 229/117.22, 117.24, 229/117.25, 117.26; 220/770, 775

[56] References Cited

U.S. PATENT DOCUMENTS

| | | | |
|---|---|---|---|
| 1,646,537 | 10/1927 | Hurley . | |
| 2,645,406 | 7/1953 | Robins . | |
| 2,690,867 | 10/1954 | Potts | 229/117.25 |
| 2,915,236 | 12/1959 | Breunig . | |
| 2,967,656 | 1/1961 | Vergobbi . | |
| 3,157,342 | 11/1964 | Grady . | |
| 3,366,306 | 1/1968 | Kotowick | 229/117.25 |
| 3,692,202 | 9/1972 | Parlagreco . | |
| 3,927,812 | 12/1975 | Winters et al. . | |
| 4,176,423 | 12/1979 | Wigemark . | |
| 4,344,534 | 8/1982 | Sutton . | |
| 4,396,128 | 8/1983 | Larson et al. . | |
| 4,516,687 | 5/1985 | Taguchi et al. . | |
| 4,669,627 | 6/1987 | Ueda et al. . | |
| 4,775,093 | 10/1988 | Lin . | |
| 4,884,837 | 12/1989 | Nakazawa . | |
| 4,986,420 | 1/1991 | Gunn et al. . | |
| 5,195,636 | 3/1993 | Wridt | 220/770 |
| 5,209,394 | 5/1993 | Griffiths et al. . | |
| 5,299,732 | 4/1994 | Armor et al. | 229/117.25 |

FOREIGN PATENT DOCUMENTS

| | | | |
|---|---|---|---|
| 114771 | 8/1984 | European Pat. Off. | 229/117.22 |
| 2653748 | 5/1991 | France | 229/117.22 |

*Primary Examiner*—Gary E. Elkins
*Attorney, Agent, or Firm*—Hardaway Law Firm

[57] ABSTRACT

A sliding and rotatable handle assembly for a container is provided by sonic welding an inner disk to an outer strip of a handle, the disk providing a flexible tongue which permits the rotation and sliding of the handle with respect to container openings through which the handle is connected.

16 Claims, 6 Drawing Sheets

SLIDE WELD HANDLE

BACKGROUND OF THE INVENTION

This invention is directed towards an improved handle and attachment means for use with paste board and cardboard containers which permit the movement of the handle in an arc about the container and provide a sliding means for retaining the installed handle in a first flush shipping position and a second overhead carrying position.

A variety of handles which can move relative to the container are known in the prior art. Representative handle types include U.S. Pat. No. 3,768,720 to Bundy which teaches a handle having terminal lugs which are used to secure a handle to a container. U.S. Pat. No. 4,986,420 provides a bayonet handle in which barbed ends are inserted through carton apertures, the handles being retained by the barbed head which engages the aperture. Since the dimensions of the handle ends must allow for insertion through an aperture, there remains the risk of accidental withdrawal of the handle through the aperture. Therefore, there is room for variation and improvement within the art.

SUMMARY OF THE INVENTION

It is thus an object of this invention to provide a rotatable handle and handle attachment method suitable for cartons.

It is a further object of this invention to provide a method of attaching a handle which sonically welds the handle to a disk positioned along the interior of a carton blank.

It is a further object of this invention to provide a handle which occupies a flush shipping position along a front of a container.

It is a further and more particular object of this invention to provide a handle which can assume an overhead position when engaged by the consumer.

It is a further and more particular object of this invention to provide an intermittent motion apparatus and process for installing a handle to a carton.

It is a further object of this invention to provide a sonically welded handle assembly which permits both a rotational and sliding movement of the handle relative to the carton.

These as well as other objects of the invention are accomplished by a handle assembly for a carton having an aperture on opposite side walls comprising:

A strap-like handle having a first end and a second end; two disks, the first and second disk overlapping the first and second handle ends, respectively; a tongue defined by an interior portion of each disk, a free end of the tongue attached to the lower surface of the respective handle end; wherein when the disks are positioned on an interior surface of the carton adjacent respective apertures, the free end of each tongue is attached to the corresponding handle end, through the respective aperture.

DETAILED DESCRIPTION

Figure 1:
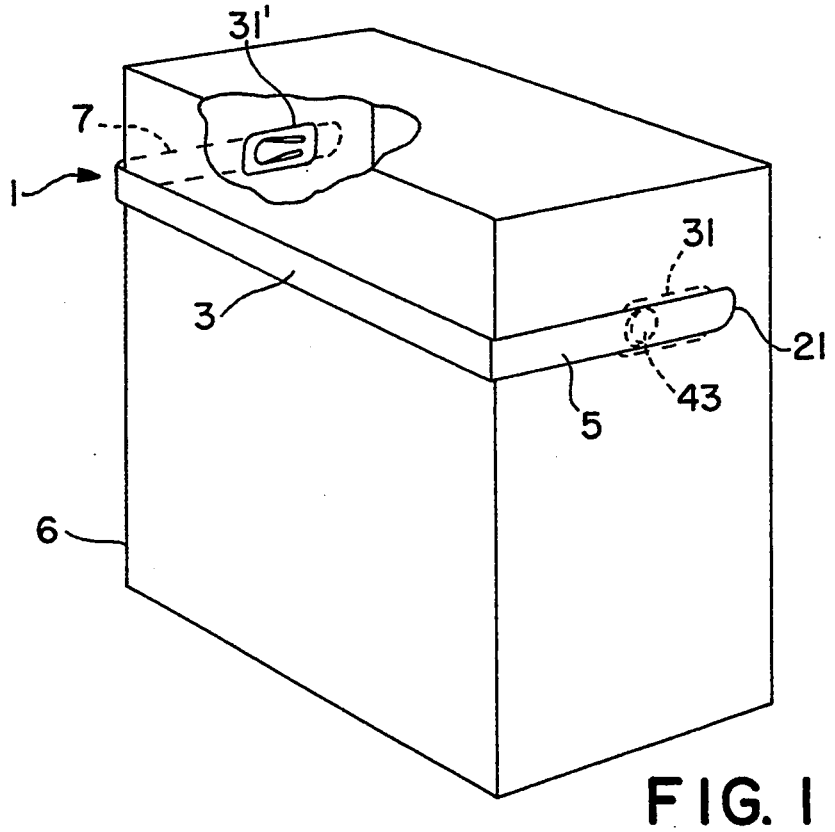
FIG. 1 of the drawings is a perspective view of the preferred embodiment of the handle attached to an assembled carton in a preferred shipping position.
Figure 2:
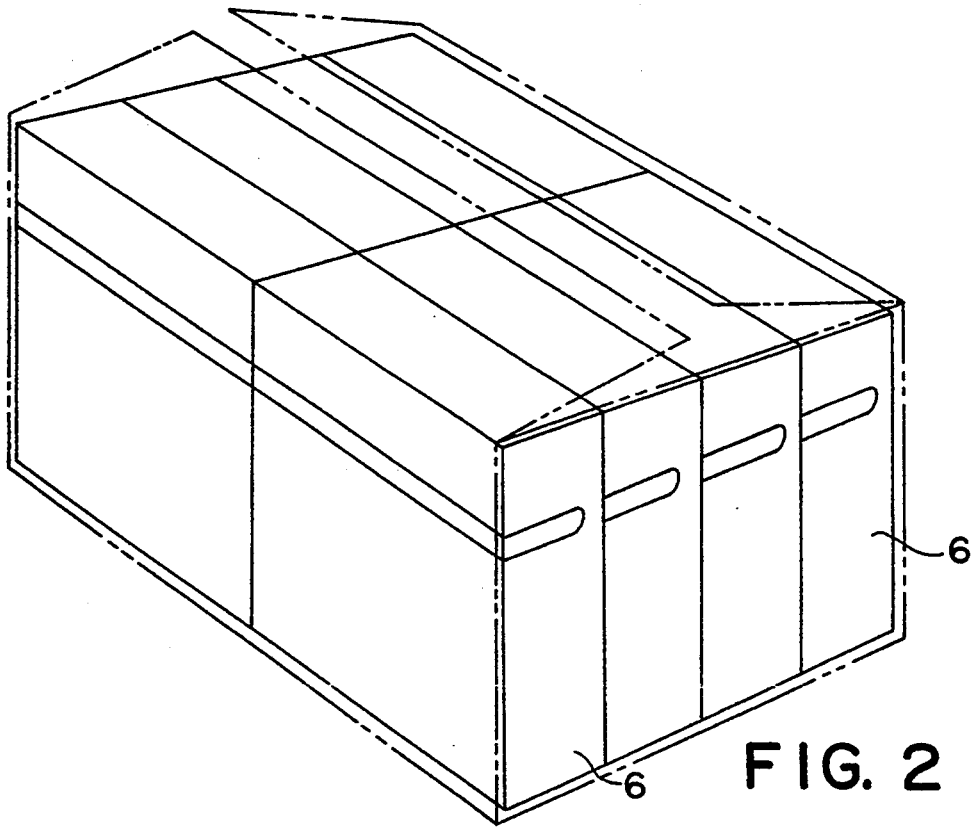
FIG. 2 of the drawings is a perspective view of a plurality of cartons assembled for shipping.

In accordance with this invention it has been found that an improved container handle assembly and attachment means can be provided which enable sliding and pivoting of the handle relative to the container. Further, the attachment means and assembly structure provide a partial seal for the openings defined by the container therefore allowing the option of large-sized products to be carried without the need of a separate carton liner.

A preferred embodiment of the present invention is seen in reference to FIGS. 1 through 5 of the drawings. Handle assembly 1 is provided by a substantially thin and flat strap handle 3 having a first end 5 and a second end 7. Rectangular disks 31 and 31' (not illustrated) are attached to a lower surface of handle 3 in proximity to ends 5 and 7, respectively. For convenience, the term "handle ends" is used to indicate the portion of the handles which includes the attachment site of the handle to the disk as described in the preferred embodiment.

Figure 4:
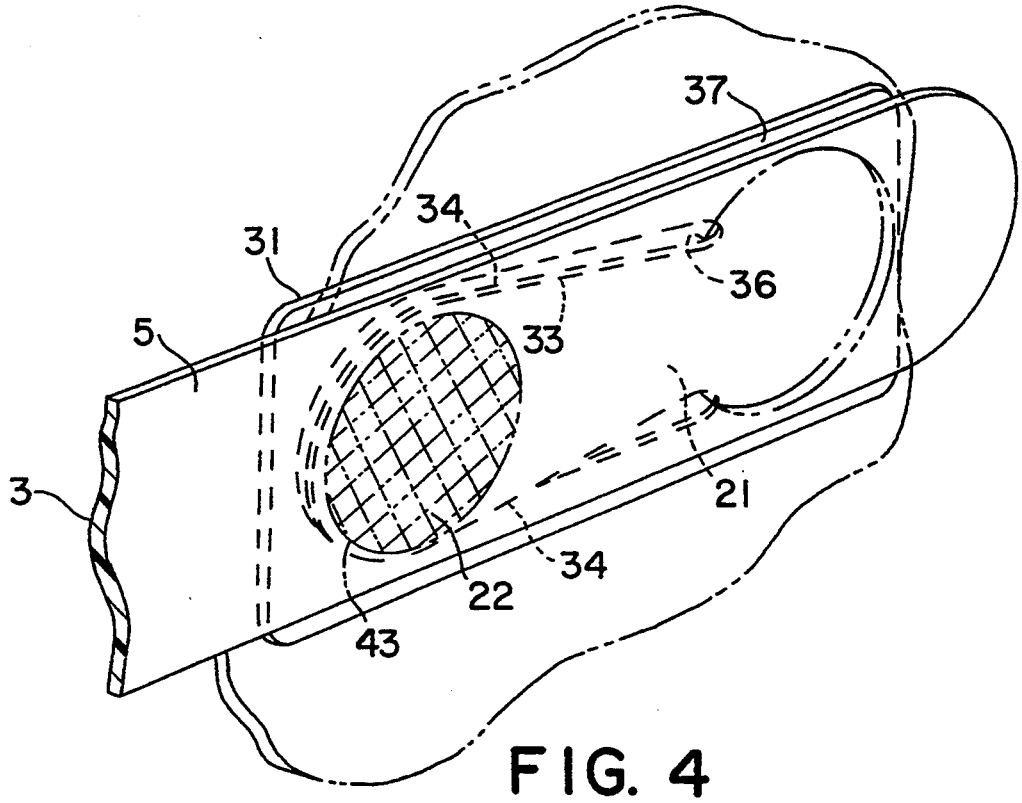
FIG. 4 of the drawings is a partial section showing additional details of a handle and disk as installed onto a carton.
Figure 5:
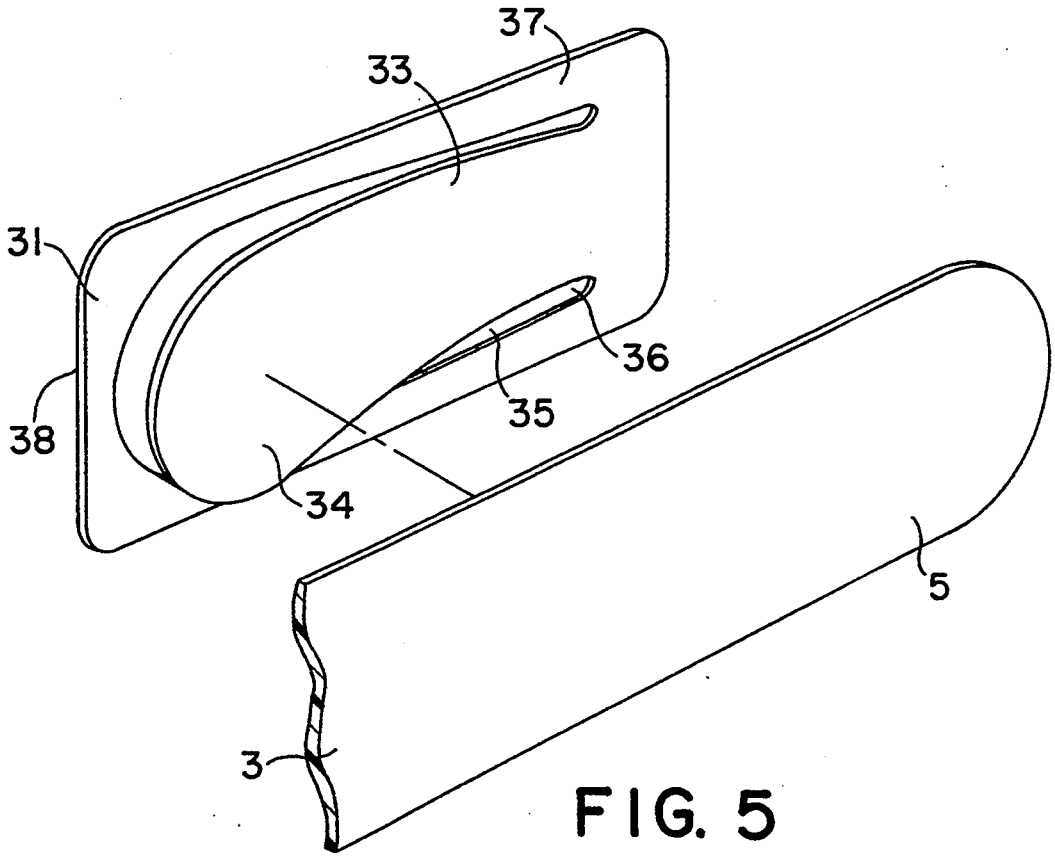
FIG. 5 of the drawings is an exploded view of the disk and handle portions showing additional detail.

As best seen in FIGS. 4 and 5, each disk 31 and 31' further defines an interior tongue 33 which is formed by a score line or die cut 35. Disk 31 and 31' are adjacent to apertures 21, respectively, which are provided along either side of an assembled carton 6. As defined herein, aperture 21 can include any size or shape container opening, such as semi-circular, since equivalent shaped openings include those which will permit the passage and rotation of the tongue 33 as described below. For clarity, references to a single disk 31 and handle end are understood to apply to the corresponding disk 31' and respective handle attachment end.

Figure 3:
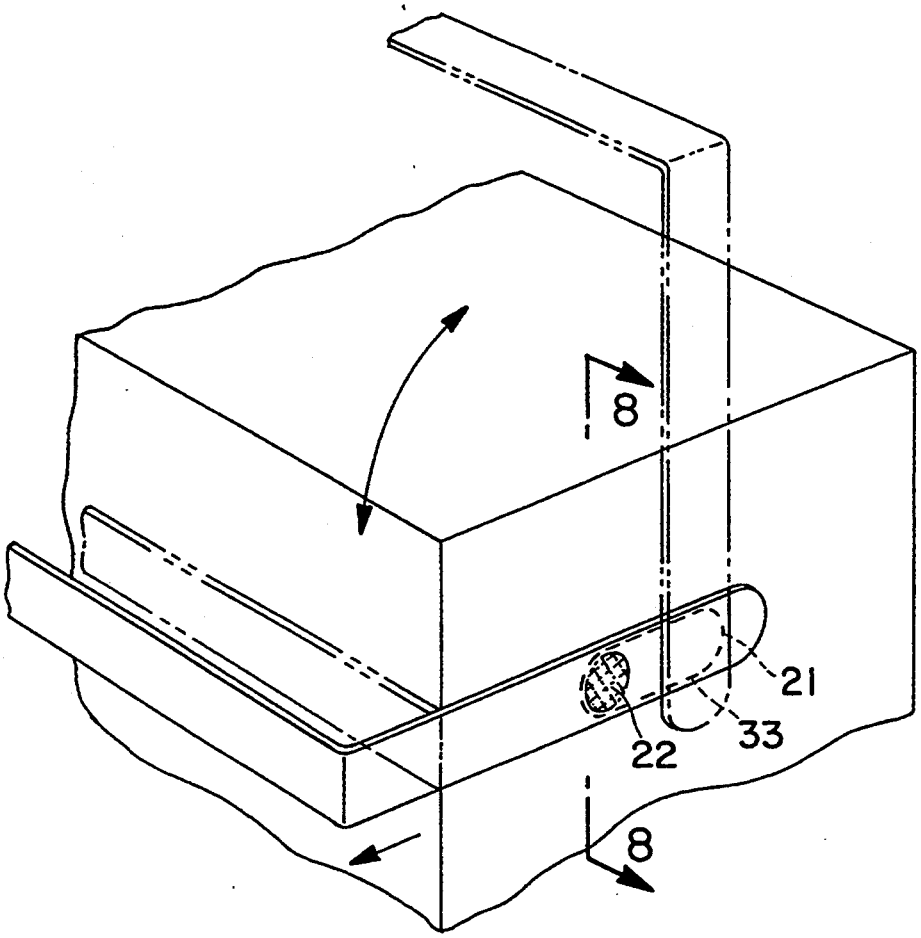
FIG. 3 of the drawings is a view similar to FIG. 1 showing the relative movement of the handle assembly with respect to an assembled carton.

Handle 3 is secured at ends 5 and 7 to the carton by the adhesion of a flat portion of each flexible tongue 33 of disk 31 to a lower handle surface. Disk 31 is positioned against the interior carton surface adjacent to aperture 21, aperture 21 providing communication between disk 31 and handle 3. As seen in FIGS. 3–5, tongue 33 is secured to the handle 3 at a spaced distance from the respective handle terminus. Therefor, when handle 3 is engaged into a carrying position, a terminal portion of each handle end overlaps the underlying carton aperture. The overlap is desired in that the carton appearance is improved. However, the handle assembly will function equally well when no overlap is provided.

A preferred securing method of attaching the handle to the carton is through sonic welding of the tongue 33 to the handle, the resulting weld being indicated by knurled pattern 22 as seen in FIGS. 3–4. The weld provides a strong attachment means for securing handle 3 to the disk 31. As seen in reference to FIG. 3, the handle attachment means permits handle assembly 1 to rotate away from the illustrated first stored position to a second engaging position seen in phantom. The rotation is aided by the rounded terminal portions 36 of cut 35, seen in FIGS. 4 and 5, facilitates easier movement of the disk and tongue about the aperture.

Figure 9:
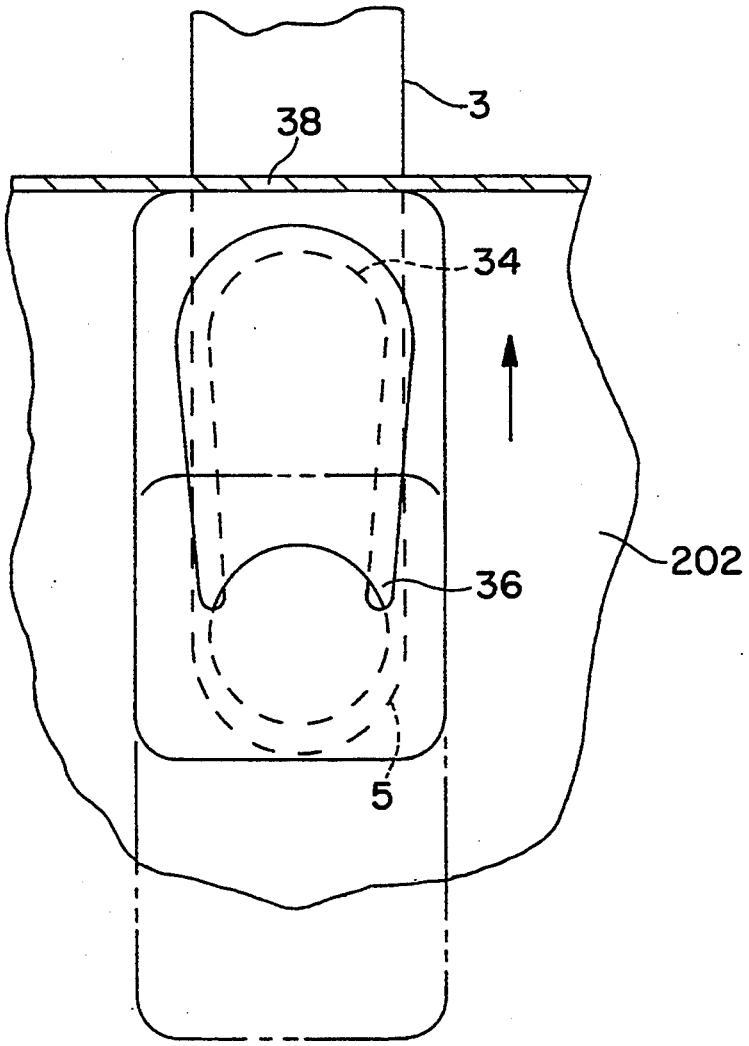
FIG. 9 of the drawings is an elevation view from the interior of a carton showing additional details of a preferred embodiment of the invention.

The tongue 33 also permits the sliding of the handle assembly with respect to the container. As seen in FIGS. 3 and 4, a first shipping position can be provided where the slidable portion of the tongue is pushed fully into the interior of the container, the handle thereby resting substantially flush against the carton front. As indicated in FIGS. 4 and 9, when the handle is grasped and used to lift the container, the slidable portion of the tongue is withdrawn from the aperture. The withdrawal permits the handle assembly to rotate and extend over the top of the carton for easier transport. The disk 31 secures the handle apparatus to the carton, disk 31 having dimensions greater than the aperture such that the disk cannot be withdrawn through the aperture.

The dimensions of disk 31 help seal the aperture so that for many applications a separate liner is not required. As seen in FIG. 4, tongue 33 is surrounded by an outer perimeter region 37 of disk 31. This outer perimeter provides a shield for the aperture along any intermediate position of the handle assembly. When engaged, a lifting force exerted upon the handle pulls the disk 31 flush against the aperture area so that the tongue and perimeter helps to maintain the container's integrity.

As seen in reference to the preferred embodiment, best seen in FIGS. 4, 5, and 9, the width of tongue 33 varies along its length. Immediately behind the welded terminal portion, tongue 33 defines a wider width region or shoulders 34 along either edge of the tongue. The preferred width across the shoulder region approaches the diameter of aperture 21. Therefor, when the tongue is fully recessed within the aperture, as occurs in a first handle assembly shipping position, the leading edges of the shoulders engage fictionally the carton wall surrounding the aperture. The shoulders provide initial resistance which helps secure the handle assembly in the stored position.

Behind shoulders 34 the tongue width steadily decreases along its length. It has been found that providing a decreased width of tongue 31 relative to the shoulders, facilitates the withdrawal of the tongue and attached handle. Maintaining the initial shoulder width along the entire slidable tongue length makes withdrawal of the handle from a filled carton difficult. The preferred embodiment allows an initial resistance which helps secure the handle for shipping. However, once engaged, the narrower tongue width and the spacing 36 provided by cut 35 facilitates the withdrawal and rotation of the handle.

The preferred shape of disk 31 provides additional advantages. When the handle assemble is in a carrying position, the disk 31 is rotated with a flat edge 38 abutting the lower lid surface of the container. As best seen in FIG. 9, the engagement of edge 38 with the carton lid greatly increases the strength of the handle assembly on an assembled, sealed container. As an upward, lifting force is applied, edge 38 of each disk rests against the inner carton lid surface. As a result, stress exerted on the handle assembly is distributed in part to the lid. As a result, the fail strength of the handle is increased as long as the lid integrity is maintained. While the illustrated disk is rectangular in shape, a wide variety of various shaped disks, including circular, would permit a disk edge to engage the lid.

For traditional applications, conventional containers are sufficiently strong so that the disk edge engagement of the container lid is not required. However, it is a preferred embodiment of the present invention, particularly with containers having a latching mechanism for a reclosable hinged lid.

Handle assembly components are preferably constructed from a resilient plastic such as high density polyethylene. High density polyethylene is recyclable, amenable to sonic welding, scoring, and permits component parts to be supplied in a preferred cartridge configuration which facilitates high speed installation of a handle. Since sonic welding does not introduce any adhesives, the handle assembly is more readily recyclable and avoids problems of misdirected adhesive during the installation process.

While more expensive, polypropylene has certain advantages for the present handle assembly component. Polypropylene can provide a transparent handle which avoids obscuring a carton design or trade dress. Further, polypropylene provides a versatile sonic welding profile which permits increased variation in sonic welding techniques. While polypropylene is also stronger than polyethylene, both polyethylene and polypropylene handle assemblies are much stronger than traditional cardboard containers.

The present handle and tabs can also be secured by the use of well known adhesives, heat sealing, or mechanical connections such as rivets. Though not preferred, such alternative securing means will maintain the rotation, sliding, and other features of the handle.

With precise installation and spotting techniques, the strap handle end regions can directly be engaged by the tongue through the aperture, the preferred width of the handle terminus and ends being greater than the dimension of the aperture. A preferred method of installation of the handle takes advantage of the fact that the handle components can be supplied and dispensed from a cartridge form, as best described in U.S. Pat. Nos. 4,946,536 and 4,832,537 which are incorporated herein by reference. Cartridge dispensing facilitates spacial and temporal coordination with associated carton blanks and attachment steps as described below.

Figure 8:
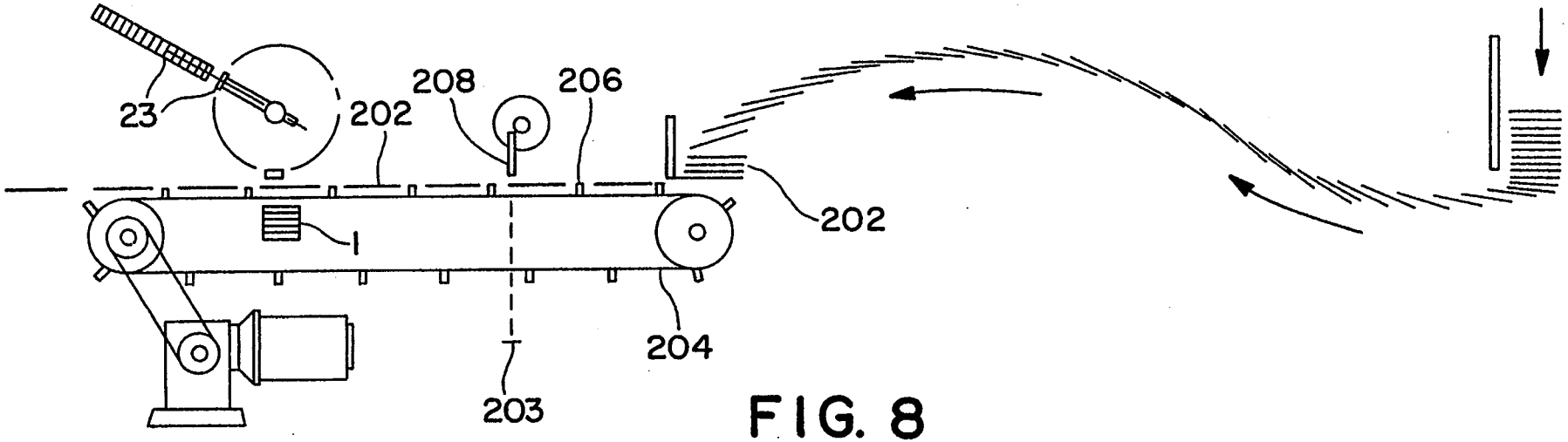
FIG. 8 of the drawings is a diagrammatic view of the process of installing a handle on a carton.

In a preferred method of installation as seen in FIG. 8, a stacked supply of carton blanks 202 is retained within a magazine, each carton blank having preformed perforations. The carton blanks are singulated and fed with the interior surface up to an associated belt conveyor 204 having lugs 206 for carrying the carton blanks. Belt 204 is driven by intermittent means such as a CAMCO geneva drive mechanism. A pair of reciprocating dies 208 are used to disengage perforations 203 from blanks 202. Following advancement of at least one carton blank width, the carton blank and conveying means are stopped while the handle and the disk are applied and secured.

As best seen in reference to FIGS. 6 through 7, a single handle 3 is dispensed below conveyor 204 and spotted so handle 3 is adjacent to the exterior surface of the carton blank stock. Upon receiving handle 3, guide plate 210 directs the handle ends against the exterior carton blank surface, the handle ends being firmly pressed against the exterior aperture opening by the guide plate. In coordination with the handle dispensing and placement, a disk cartridge dispenser positions a disk, with tab-like tongue 33 already defined, adjacent to each inner aperture opening.

Figure 6A:
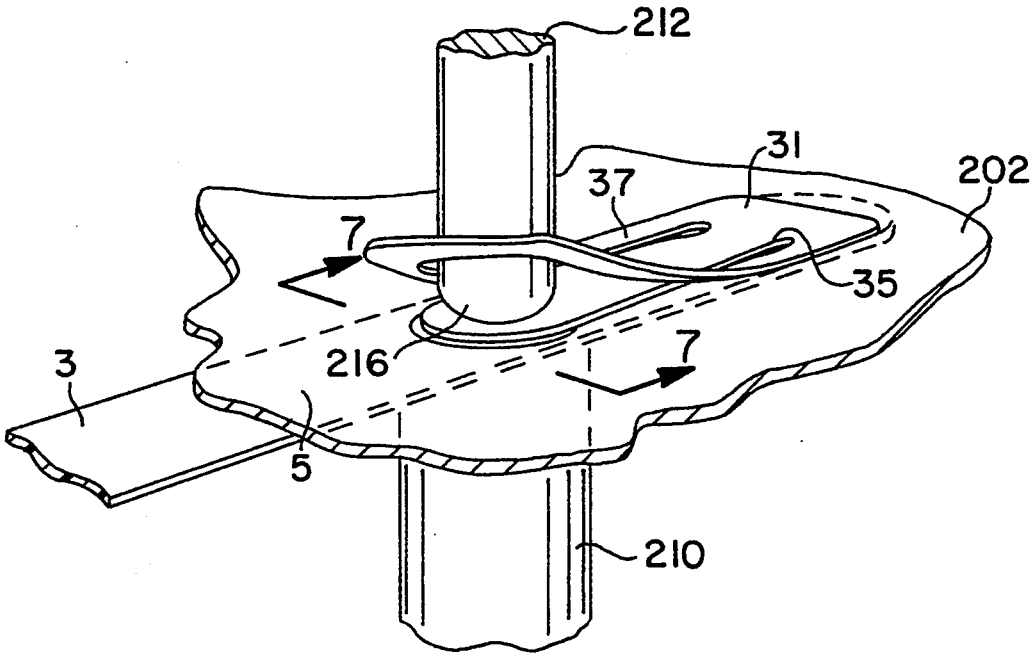
FIG. 6*a* of the drawings is a perspective view in partial section of a handle assembly being secured to a side wall of a carton.
Figure 6B:
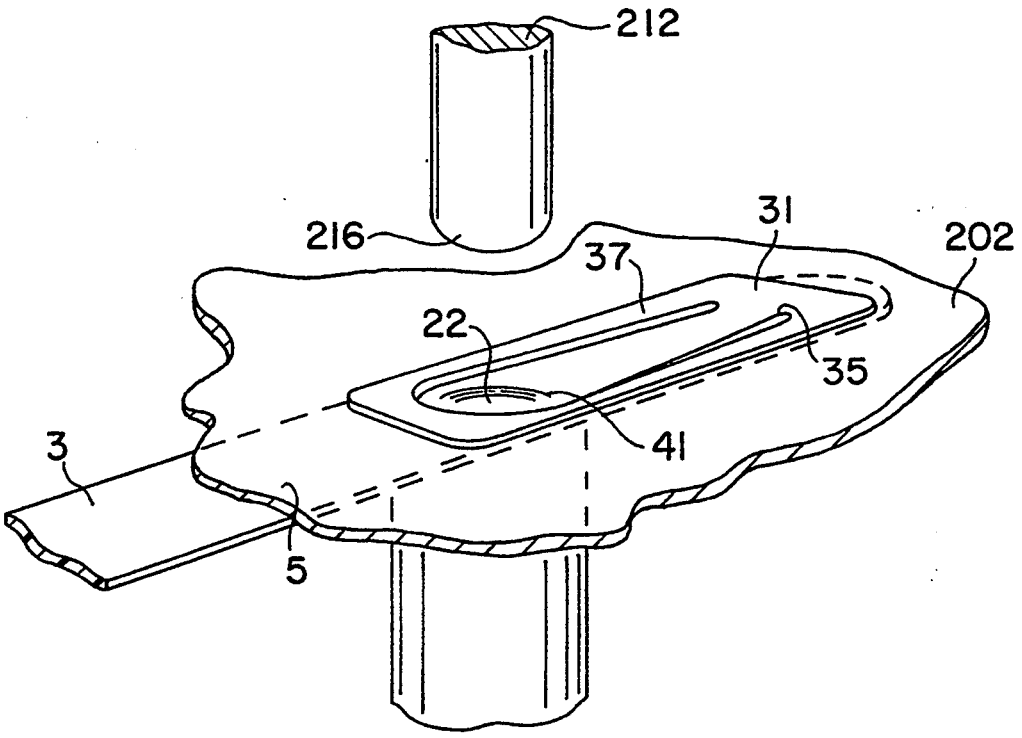
FIG. 6*b* of the drawings is similar to FIG. 6 showing details of a handle assembly secured to a side wall of a carton.
Figure 7:
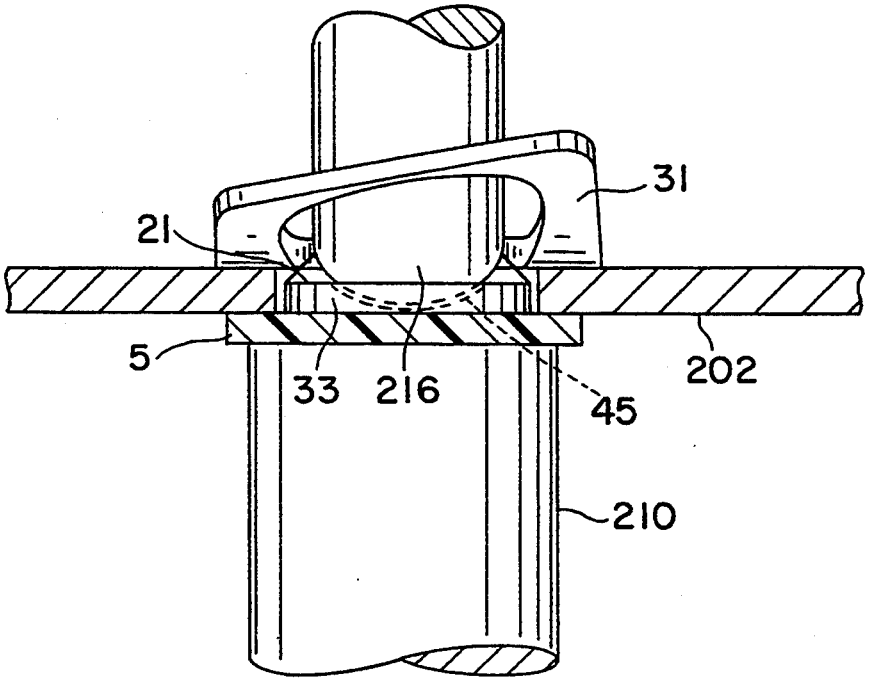
FIG. 7 of the drawings is a cross-section view in the direction of line 7—7 of FIG. 6.

As seen in FIG. 6, when handle end 5 is in proximity to the exterior aperture surface, corresponding disk 31 is positioned on the opposite side of the aperture. The terminal portion of tongue 33 of disk 31 is sonically welded to the corresponding portion of the overlapped handle end through the common aperture. This process simultaneously attaches tongues of both disks 31 and 31' to the corresponding portion of handle ends 5 and 7, respectively.

The tongue also provides a flexible and resilient member for connecting the handle to the disk 31. The deformable tab-like nature of the tongue also facilitates the engagement of the tongue's free end during the sonic welding process.

The welding steps are accomplished by an ultrasonic welder 212 having a horn tip 216 which engages the respective tongue/handle overlap opposite the corresponding aperture. Point pressure is applied to the disk by the horn tip, the sonic welder operating at a frequency of around 20,000 Hertz which has been found to seal the disk to the handle in approximately 0.25 seconds. However, a wide range of time, pressure and frequency combinations can be selected for particular applications. The horn tip can be circular, rectangular or any other configuration which will permit the sonic welding oscillation and pressure to be transmitted through the aperture.

To facilitate the welding process, handle guide means 210 also retains the disk and tongue in a fixed, flush position against the aperture so that downward point pressure of the horn is conveyed to the free end of the tongue. Applying pressure to the tongue results in a concave depression 41 being formed in the tongue surface opposite the horn. A corresponding convex "button" 43 results on the exterior handle surface adjacent the weld sight. The formation of the depression 41 and button 43 can be facilitated by having the guide plate 210 define a similar shaped cup 45 in the engaging surface.

Having the concave surface immediately adjacent the aperture permits an easier insertion and withdrawal of the handle assembly. A raised or convex surface immediately adjacent the aperture could interfere with the tongues withdrawal from a filled carton. Upon disengagement of the horn tip, the carton and attached handle assembly are transported to an associated apparatus for folding and filling a carton.

The present invention offers several advantages over current handles. Attachment means of the handle with the sliding disk connector seals the apertures against product leakage and contamination. As a result, separate liners do not need to be installed. However, the instant invention is compatible with a liner, the inner liner simply being installed over the disks. Further, the welded disk/handle connection permits the handle to be repositioned from a flush shipping profile into an upright carrying position, the sliding disk and tongue permitting lateral movement and rotation of the handle assembly through and about the aperture.

As numerous modifications of the preferred embodiment of the handle and the process described above are possible to one having ordinary skill in the art upon reading the description, the scope of the present invention is hereby set forth by the following appended claims.

That which is claimed:

1. A package for housing granular or similar material, said package comprising;

an enclosure having a first side wall and a second side wall, each said side wall defining an aperture therein, said enclosure further defining a front wall and a top wall;

a handle comprising a first disk and a second disk, said first and second disks adjacent said aperture in said first and second side walls, respectively, said disks positioned alongside an interior of said side walls;

a first and second flexible tongue, said first and second tongues defined by a scoreline along an interior portion of said first and second disks, respectively, each said tongue being inserted through said respective aperture, a free end of said first tongue attached to a first end of a strap and a free end of said second tongue attached to a second end of said strap.

2. The package according to claim 1 wherein said handle is slidable along a length of each said tongue.

3. The package according to claim 1 wherein said handle has a shipping position where a slidable length of said first tongue and said second tongue are housed within said enclosure, thereby positioning said strap flush against the exterior of said package.

4. The package according to claim 1 wherein said handle has a carrying position where said slidable length of said first tongue and said second tongue are extended through each said respective aperture to the exterior of said container, each said disk and said tongue rotating about said respective aperture, said strap thereby occupying a position over a top of said package.

5. A combination container and handle for said container comprising:

a container comprising a first side wall and a second side wall, each said side wall defining an aperture therein;

a handle, said handle comprising a strap having an inner surface, an outer surface, a first end and a second end;

a first disk positioned on an interior surface of said first side wall and adjacent said aperture, said first disk further defining a flexible tongue attached through said aperture to said first strap end;

a second disk positioned on an interior surface of said second side wall and adjacent said aperture, said second disk further defining a flexible tongue attached through said aperture to said second strap end.

6. The combination container and handle according to claim 5 wherein said first disk and said second disk are attached to said respective inner surface of said first strap end and said second strap end.

7. A combination container and handle for said container comprising:

a container comprising a first side wall and a second side wall, each said side wall defining an aperture therein;

a handle, said handle comprising a strap having an inner surface, an outer surface, a first terminus and an adjacent first end portion and a second terminus and an adjacent second end portion;

a first disk positioned on an interior surface of said first side wall and adjacent said aperture, said first disk further defining a flexible tongue, said tongue having an attached disk end, a free end, and a slidable length therebetween, said slidable length in communication with said first aperture, said free end of said tongue attached through said aperture to said inner surface of said first strap end portion;

a second disk positioned on an interior surface of said second side wall and adjacent said aperture, said second disk further defining a flexible tongue said tongue having an attached disk end, a free end, and a slidable length therebetween, said slidable length in communication with said second aperture, said free end of said tongue attached through said aperture to said inner surface of said second strap end portion.

8. The handle and container combination according to claim 7 wherein said slidable length of said first tongue further defines a shoulder region adjacent said tongue free end, said shoulder region having a width substantially equal to a diameter of said respective aperture.

9. The handle and container combination according to claim 7 wherein said free end of each said tongue is secured to said strap by a sonically formed weld.

10. The handle and container combination according to claim 7 wherein said first disk defines a gap between said tongue and a surrounding portion of said disk.

11. The handle and container combination according to claim 8 wherein said slidable length further defines a reduced width portion between said shoulder region and said attached disk end.

12. The handle and container combination according to claim 9 wherein said weld defines a concave surface on an exposed surface of said tongue, said concave surface in communication with said aperture when said strap is in a shipping position.

13. The handle and container combination according to claim 7 wherein said strap and said disk are constructed of polypropylene.

14. The handle and container combination according to claim 7 wherein said strap and said disk are constructed of polyethylene.

15. A handle and container combination according to claim 7 wherein said handle has a carrying position where a slidable length of each said tongue is extended through said respective aperture to the exterior of said container, each said disk and said tongue rotating about said aperture, said strap thereby occupying a position over a top of said container.

16. The handle and container combination according to claim 15 wherein when said strap is in said carrying position, an edge of said first disk and an edge of said second disk engages an inner surface of a container top.

* * * * *